US007860418B2

(12) United States Patent
VanKouwenberg et al.

(10) Patent No.: US 7,860,418 B2
(45) Date of Patent: Dec. 28, 2010

(54) SYSTEM AND METHOD FOR COOLING A ROLLER HAVING MULTIPLE HEATING ZONES

(75) Inventors: David Alan VanKouwenberg, Avon, NY (US); Andrew Wayne Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 880 days.

(21) Appl. No.: 11/809,127

(22) Filed: May 31, 2007

(65) Prior Publication Data

US 2008/0298831 A1 Dec. 4, 2008

(51) Int. Cl.
*G03G 15/20* (2006.01)
*G03G 15/00* (2006.01)

(52) U.S. Cl. ..... 399/69; 399/92; 399/307; 399/334

(58) Field of Classification Search ..... 399/69, 399/92, 307, 328, 334; 347/156
See application file for complete search history.

(56) References Cited

U.S. PATENT DOCUMENTS 5,561,512 A * 10/1996 Fukano et al. ..... 399/69
5,787,321 A * 7/1998 Nishikawa et al. ..... 399/69
5,835,830 A * 11/1998 Fukuda et al. ..... 399/307
6,185,836 B1 2/2001 Zaoralek ..... 34/119
6,567,629 B2 5/2003 Anderson et al. ..... 399/92
7,054,572 B2 5/2006 Baruch et al. ..... 399/69
7,421,219 B2 * 9/2008 Matsuura et al. ..... 399/334 X
7,609,991 B2 * 10/2009 Koshida ..... 399/92
2005/0207801 A1 * 9/2005 Kunii et al. ..... 399/307
2006/0078428 A1 * 4/2006 Zheng ..... 415/206

* cited by examiner

*Primary Examiner*—Sophia S Chen
(74) *Attorney, Agent, or Firm*—Maginot, Moore & Beck LLP

(57) ABSTRACT

A printer includes a system for cooling an image receiving member. The image receiving member cooling system includes an image receiving member having a first end and a second end, a first heater mounted within the image receiving member for heating the image receiving member in the vicinity of the first end, a second heater mounted within the image receiving member for heating the image receiving member in the vicinity of the second end, a first temperature detector located proximate the first end of the image receiving member, a second temperature detector located proximate the second end of the image receiving member, a fan mounted at one end of the image receiving member, and a controller electrically coupled to the first and the second temperature detectors and the fan, the controller for activating the fan to move air from the end at which a higher temperature is detected past the other end.

14 Claims, 4 Drawing Sheets

SYSTEM AND METHOD FOR COOLING A ROLLER HAVING MULTIPLE HEATING ZONES

TECHNICAL FIELD

This disclosure relates to imaging devices having rollers heated with multiple heaters and, more particularly, to imaging devices having image receiving members that are heated with different heaters.

BACKGROUND

Imaging devices use a variety of marking materials to generate a physical image of an electronic image. The materials include, for example, aqueous ink, melted ink and toner. The marking material may be ejected onto or developed on an image receiving member. For example, electronic image data may be used to generate a latent image on a photoreceptor belt and then the latent image is developed with toner material in a development station. With aqueous ink or melted ink, a print head ejects the melted ink onto an image receiving member. The firing of the ink jets in the print head to deposit the material on the image receiving member is manipulated by a print head controller using electronic image data.

Once the marking material is deposited onto an image receiving member, the image may be transferred or transfixed to an image media. For example, a sheet or web of image media may be moved into a nip formed between the image receiving member and a transfix or fuser roller so the image may be transferred to the image media. The movement of the image media into the nip is synchronized with the movement of the image on the image receiving member so the image is appropriately aligned with and fits within the boundaries of the image media. The pressure within the nip helps transfix or fuse the marking material onto the image media.

The image receiving member is typically heated to improve compatibility of the image receiving member with the inks deposited on the member. The image receiving member may be, for example, an anodized and etched aluminum drum. Within the drum, a heater reflector may be mounted axially within the drum. A heater is located at approximately each end of the reflector. The heater reflector remains stationary as the drum rotates. Thus, the heaters apply heat to the inside of the drum as the drum moves past the heaters on the reflector. The reflector helps direct the heat towards the inside surface of the drum. Each of the heaters is coupled to a controller. The controller is also coupled to temperature sensors located near the outside surface of the drum. The controller selectively operates the heaters to maintain the temperature of the outside surface within an operating range.

Differences in temperatures of the components interacting during a print cycle cause thermal gradients to appear sometimes across the outside surface of the image drum. For example, the controller operates the heaters in an effort to maintain the temperature of the outside surface in a range of about 55 degrees Celsius, plus or minus 5 degrees Celsius. The ink that is ejected onto the print drum has a temperature of approximately 110 to approximately 120 degrees Celsius. Thus, images having areas that are densely pixilated, may impart a substantive amount of heat to a portion of the print drum. Additionally, the drum experiences convective heat losses as the exposed surface areas of the drum lose heat as the drum rapidly spins in the air about the drum. Also, the contact of the recording media with the print drum also affects the surface temperature of the drum For example, paper placed in a supply tray has a temperature roughly equal to the temperature of the ambient air. As the paper is retrieved from the supply tray, it moves along a path towards the transfer nip. Typically, this path includes a media pre-heater that raises the temperature of the media. These temperatures may be approximately 40 degrees Celsius. Thus, when the media enters the transfer nip, areas of the print drum having relatively few drops of ink on them are exposed to the cooler temperature of the media. Consequently, densely pixilated areas of the print drum are likely to increase in temperature, while more sparsely covered areas are likely to lose heat to the passing media. These differences in temperatures result in thermal gradients across the print drum Efforts have been made to control the thermal gradients across a print drum for the purpose of maintaining the surface temperature of the print drum within the operating range. Simply controlling the heaters is insufficient because the ejected ink may raise the surface temperature of the print drum above the operating range even though the heater in that region is off. To provide cooling, a fan has been added at one end of a print drum The print drum is open at each flat end of the drum. To best provide cooling, the fan is located outside the print drum and is oriented to blow air from the end of the drum at which the fan is located to the other end of the drum where it is exhausted. The fan is electrically coupled to the controller so the controller activates the fan in response to one of the temperature sensors detecting a temperature exceeding the operating range of the print drum. The air flow from the fan eventually cools the overheated portion of the print drum and the controller deactivates the fan.

While the fan system described above works for maintaining the temperature of the drum within an operating range, it possess some inefficiencies. Specifically, inefficiency arises when the surface portion of the print drum at which the air flow is exhausted has a higher temperature than the surface area near the end at which the fan is mounted. In response to the higher temperature detection, the controller activates the fan. As the cooler air enters the drum, it absorbs heat from the area near the fan that is within operating range. This cooling may result in the controller turning on the heater for that region to keep that area from falling below the operating range. Even though the air flow is heated by the region near the fan and/or the heater in that area, it still is able to cool eventually the overheated area near the drum end from which the air flow is exhausted. Nevertheless, the energy spent warming the region near the fan and the additional time required to cool the overheated area with the warmed air flow from the fan adds to the operating cost of the printer. Therefore, more efficient cooling of the print drum would be useful.

SUMMARY

To address the issues arising from inefficiency in cooling overheated areas of an image receiving member in a printer, a system for cooling a portion of an image receiving member has been developed. The image receiving member cooling system includes an image receiving member having a first end and a second end, a first heater mounted within the image receiving member for heating the image receiving member in the vicinity of the first end, a second heater mounted within the image receiving member for heating the image receiving member in the vicinity of the second end, a first temperature detector located proximate the first end of the image receiving member, a second temperature detector located proximate the second end of the image receiving member, a fan mounted at one end of the image receiving member, and a controller electrically coupled to the first and the second temperature detectors and the fan, the controller for activating the fan to move air from the end at which a higher temperature is detected past the other end.

A method implemented by the thermal gradient control system helps ensure a more uniform distribution of temperature across the image receiving member. The method includes detecting a temperature at a first portion of a heated image receiving member being greater than a temperature threshold, detecting a temperature at a second portion of the heated image receiving member being less than the temperature threshold, and directing air flow from the first portion of the heated image receiving member past the second portion. The directing of the air flow may include the control of two separate fans or the control of a single bi-directional fan.

DETAILED DESCRIPTION

Figure 1:
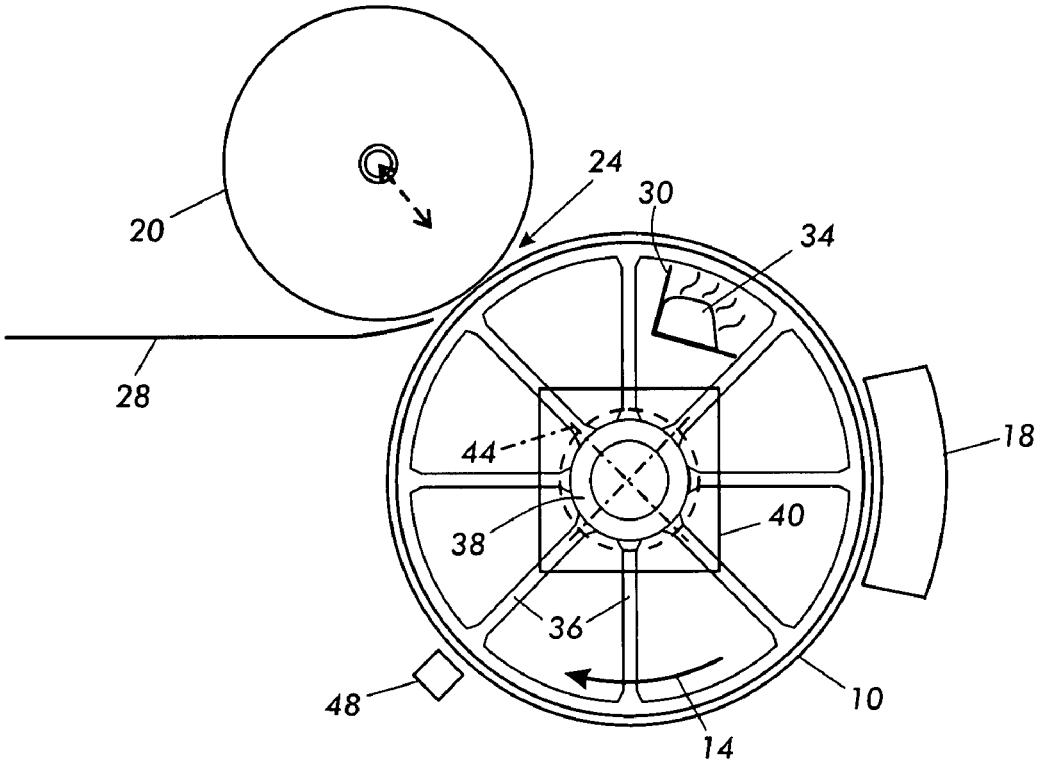
FIG. 1 is a side view of a printer showing an image receiving member and the relationship of cooling system components to the image receiving member.

FIG. 1 is a side view of a printer showing major components for forming an image and a portion of the cooling system for an image receiving member. The printer includes an image drum 10 onto which melted ink is ejected by a print head 18 as the drum rotates in the direction 14. One or more revolutions of the drum 10 are required before an image is formed on the drum A transfer or transfix roller 20 is displaceable towards and away from the drum 10 to form a nip 24 between them in a selective manner. The nip 24 is formed in synchronization of an image approaching the area between the transfer roller 20 and the print drum 10. A media path 28 supports recording media and directs media into the nip 24. Delivery of recording media to the nip 24 is also synchronized with the approach of an image towards the transfer roller 20. After passing through the nip to receive an image from the image receiving member 10, the media exits to the output tray on a media output path (not shown).

The image drum 10 includes a heat reflector 30 into which a heater 34 is mounted. The reflector 30 and heater 34 remain fixed as drum 10 rotates past the heater 34. The heater 34 generates heat that is absorbed by the inside surface of the drum 10 to heat the image receiving drum as it rotates past the heater. Although the heater 34 is shown as being located so it heats the inside surface of the drum, it may also be located externally of the drum to heat the external surface. A cooling system for the drum 10 includes a hub 38 that is preferably centered about the longitudinal center line of the image drum 10. A fan 40 is mounted outboard of the hub 38 and oriented to direct air flow through the drum. A temperature sensor 48 is located proximate the outer surface of the drum 10 to detect the temperature of the drum surface as it rotates.

In more detail, the drum 10 may be, for example, an aluminum drum that has been anodized and etched. Other image receiving members, however, may be used with the cooling system disclosed herein. Each end of the drum 10 may be open with a hub 38 and spokes 36 as shown in FIG. 1. The hub may be provided with a pass through for passage of electrical wires to the heater(s) within the drum. Additionally, the hub has a bearing at its center so the drum may be rotatably mounted in a printer. The spokes 36 extend from the hub 38 to support the cylindrical wall of the drum 10 and provide airways for air circulation in the drum 10. The heater 34 that heats the drum 10 may be a convective or radiant heater. The fan 40 may be a muffin fan or other conventional electrical fan. The fan may also be a DC fan or a bi-directional fan. A bi-directional fan is one that can push or pull an air flow in response to an activation signal and a direction signal. The direction of fan blade rotation in a DC fan depends upon the polarity of the DC power source applied to the fan. Thus, a DC fan may be made to blow air in one direction or the other by controlling the polarity of the source voltage to the fan. For most typical printing applications, the fan 40 should produce air flow in the range of approximately 45-55 cubic feet per minute (CFM) of air flow, although other air flow ranges may be used depending upon the thermal parameters of a particular application. The temperature sensor 48 may be any type of temperature sensing device that generates an analog or digital signal indicative of a temperature in the vicinity of the sensor. Such sensors include, for example, thermistors or other junction devices that predictably change in some electrical property in response to the absorption of heat. Other types of sensors include dissimilar metals that bend or move as the materials having different coefficients of temperature expansion respond to heat.

Figure 2:
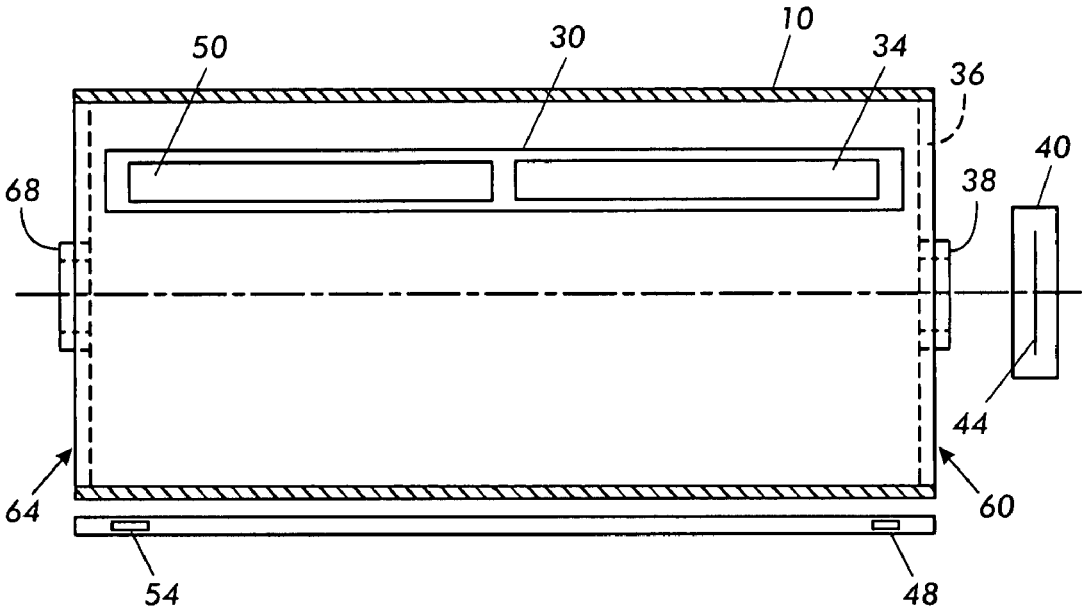
FIG. 2 is a front view of the image receiving member shown in FIG. 1.

A cross-sectional view of the drum 10 through the center of the hub 38 is shown in FIG. 2. The drum 10 has a longitudinal axis running through the center of the hub 38 at the first end 60 and through the center of the hub 38 at a second end 64. The second end 64 also includes a hub 68 from which spokes 36 also extend to support the cylindrical wall of the drum 10. The voids between the spokes 36 at each end of the drum 10 facilitate air flow through the drum 10. Within the reflector 30 is mounted another heater 50. The heater 34 heats a first portion of the drum 10 and the heater 50 heats a second portion of the drum 10. Other heaters may be mounted within the reflector 30 if more localized area control of the drum heating is required. Also, a second temperature sensor 54 is mounted proximate the second end 64 to sense the temperature near the second end of the drum 10. Additional temperature sensors may be mounted about the drum 10, however, the temperature sensors are preferably mounted in a linear arrangement as shown in FIG. 2. Although the temperature sensors are shown as being located near the ends of the drum 10, they may be located closer towards the center of the drum along the longitudinal axis of the drum.

Fan 40 is a bi-directional fan. That is, the direction of rotation for the fan blade 44 may be controlled by an appropriate signal to the fan. When the blade 44 rotates in one direction, air flows from fan 44 through the drum 10 for exhausting at end 64. When the blade 44 rotates in the opposite direction, air flows from end 64 for exhausting at end 60. In a similar manner, fan 40 may be a DC fan and the polarity of the supply voltage to the fan determines the direction of fan blade rotation and the direction of the air flow through the drum 10. Thus, a bi-directional fan and DC fan provide two directions of air flow through the drum 10 with a single fan. The advantage of a bi-directional fan is that the blade of such fans is shaped so the air flow is approximately the same regardless of the direction in which the blade is turning. A DC muffin fan does not necessarily have a fan blade that produces the same air flow in each direction. Consequently, air flow in one direction may be greater than air flow in the other direction.

Figure 6:
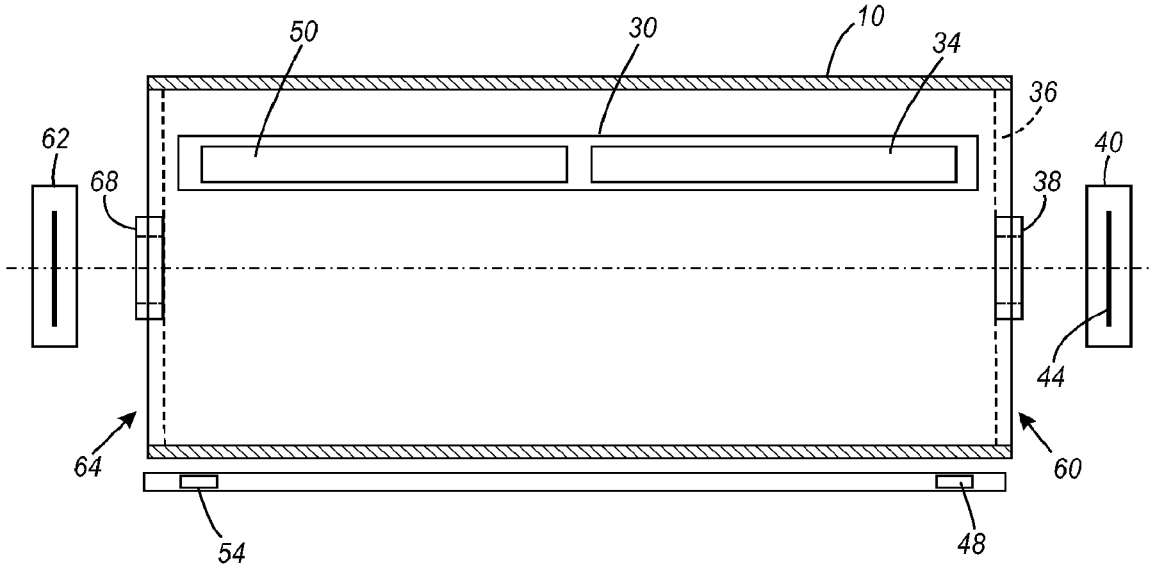
FIG. 6 illustrates an embodiment of an image receiving member being cooled by two fans.

In another embodiment shown in FIG. 6, a second fan 62 is mounted at the second end 64. The second fan 62 is mounted outboard of the end 64 and is oriented to direct air flow into the drum 10 for exhaustion at end 60. In this embodiment, the two fans may be single direction fans that are independently controlled. When the first fan is activated to provide air flow from end 60 to end 64, the second fan 62 remains off. When the second fan 62 is activated to provide air flow from end 64 to end 60, the first fan remains off. Of course, both fans may also be bi-directional fans or DC fans. In this arrangement, when the first fan is controlled to move air from end 60 to end 64, the second fan 62 is operated in the direction that also pulls air from end 60 to end 64. Similarly, the two bi-directional fans may be operated simultaneously to move air from end 64 to end 60 for exhaustion.

Figure 3:
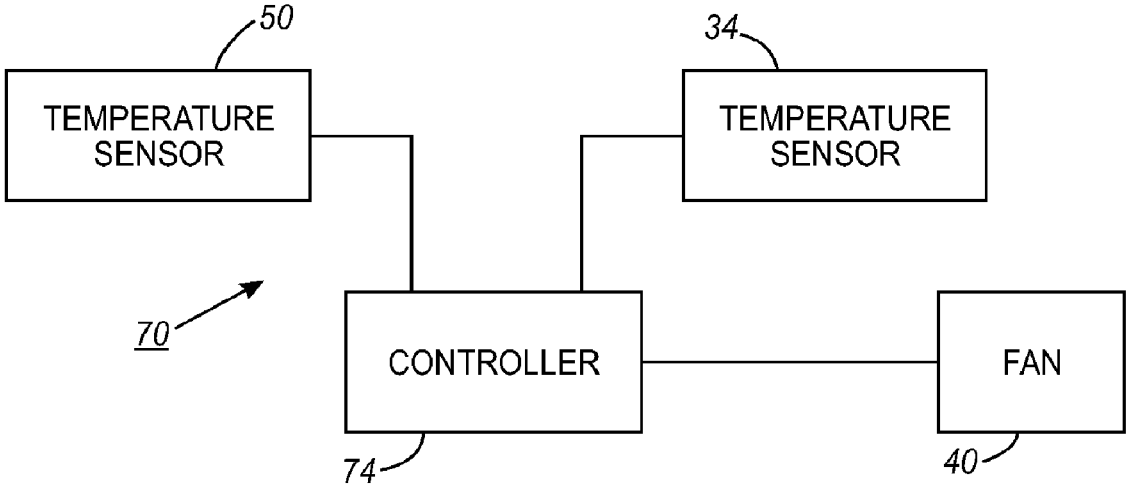
FIG. 3 is a block diagram of a cooling system that improves energy efficiency for cooling the image receiving member shown in FIG. 1.

A block diagram for the cooling system is shown in FIG. 3. The cooling system 70 includes a controller 74, the temperature sensors 34, 50, and the fan 40. The controller 74 may be a general purpose microprocessor that executes programmed instructions stored in a memory or it may be an application specific integrated circuit (ASIC). Alternatively, the controller 74 may be implemented with discrete electronic components or with a combination of programmable components and discrete components. The signals from sensors 34, 50 may be analog signals that are digitized by an A/D converter, which is interfaced to the controller 74. The controller 74 receives temperature values from the temperature sensors 34, 50 and compares those values to thresholds using programmed instructions. In one embodiment, the two temperature values may be compared to one another to determine which one is greater. The controller 74 may be configured to detect whether one or both of the temperatures are greater than a threshold. If only one is greater than a threshold, then the controller 74 operates the fan 40 to move air from the end at the warmer end through the drum to the cooler end. If both temperatures exceed the threshold, the controller operates the fan to move air in a predetermined direction. The predetermined direction corresponds to air flow from the drum end that is closest to significant thermal generators, such as ink melters, electronic assemblies, or motors. Once the operation of the fan results in one of the temperatures falling below the threshold, the controller operates the fan to blow from the end still exceeding the threshold. In the block diagram of FIG. 3, the fan 40 is a bi-directional fan. In another embodiment, a second fan may also be coupled to the controller 74 and the controller is configured for independent control of the fans.

The reader may ascertain from the above description that the cooling system disclosed herein usually moves air from the warmer end of the print drum to the cooler end. Although the warmer end may initially heat the cooler end, the flow of the warmer air away from the warmer end eventually reduces the temperature at the warmer end without causing the heater at the cooler end to activate. Thus, energy is conserved as operation of both a heater and a fan is avoided. This is an improvement over previously known systems in which movement of air from the cooler end to the warmer end may result in the heater being activated at the cooler end while the fan continues to run.

Figure 4:
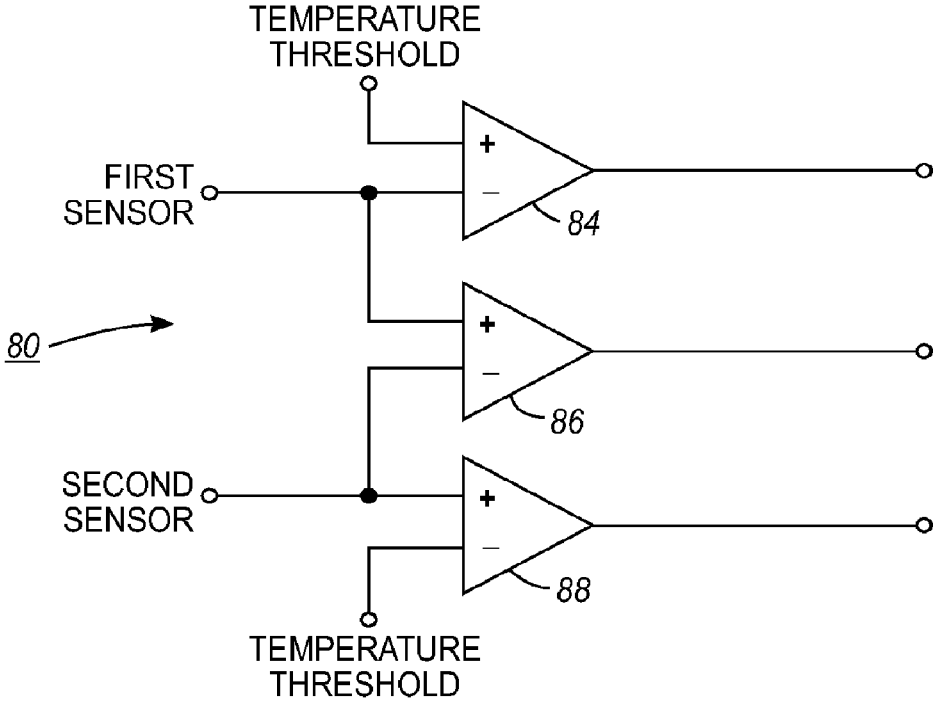
FIG. 4 is a schematic of a temperature comparator that may be used in the cooling system.

In another embodiment, the temperature comparators maybe implemented in a temperature comparator circuit. An exemplary temperature comparator circuit is shown in FIG. 4. The temperature comparator circuit 80 includes three differential amplifiers configured to operate as comparators. The comparator 84 compares the temperature signal from the first temperature sensor to a temperature threshold and the comparator 88 compares the temperature signal from the second temperature sensor to the temperature threshold. The signal output by the comparator 84 indicates whether the temperature sensed by the first temperature sensor 34 is greater than the temperature threshold and the signal output by the comparator 88 indicates whether the temperature sensed by the second temperature sensor 50 is greater than the temperature threshold. The comparator 86 compares the first temperature signal to the second temperature signal to determine which one is greater. The controller 74 may be configured to receive these three signals and determine which fan to operate in a two fan embodiment or in which direction to operate the fan in a single fan embodiment.

Figure 5:
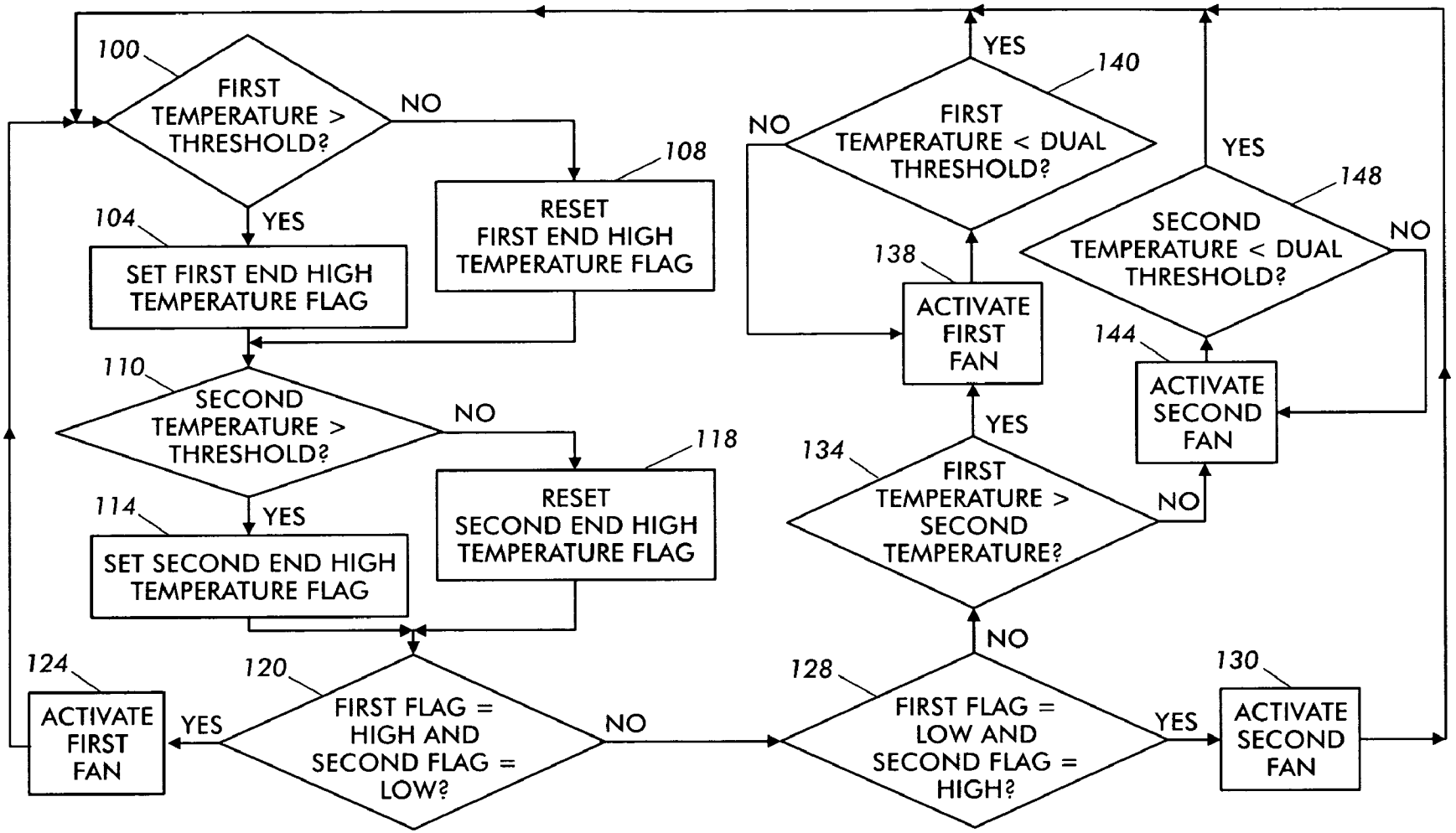
FIG. 5 is a flow diagram of a method for cooling an image receiving member.

The controller may be configured to operate one or two fans in a manner that improves the efficiency of the drum cooling process over processes previously known. An exemplary method of operation for a controller configured to read temperature values from the temperature signals is shown in FIG. 5. The process detects whether a temperature sensed by the first temperature sensor is greater than the temperature threshold (block 100). If the temperature is greater than the threshold, the first end high temperature flag is set (block 104). Otherwise, the first end high temperature flag is reset (block 108). The process then detects whether a temperature sensed by the second temperature sensor is greater than the temperature threshold (block 110). If the temperature is greater than the threshold, the second end high temperature flag is set (block 114). Otherwise, the second end high temperature flag is reset (block 118). If the first end high temperature flag is set and the second end high temperature flag is reset (block 120), then the first fan is activated to move air from the first end past the second end (block 124). The process then continues to monitor the temperatures sensed by the sensors (block 100). If the second end high temperature flag is set and the first end high temperature flag is reset (block 128), then the second fan is activated to move air from the second end past the first end (block 130). The process then continues to monitor the temperatures sensed by the sensors (block 100). If the first end high temperature flag and the second end high temperature flag are not different, then both flags have been set. In response to this condition, the process determines which detected temperature is higher (block 134). If the first temperature is higher, then the first fan is activated to move air from the first end past the second end (block 138). The first temperature is then measured and compared to a dual temperature threshold (block 140). The dual temperature threshold is lower than the threshold used if only one temperature indicates the drum needs cooling. The dual temperature threshold enables the process to establish a portion of the drum at temperature sufficiently below the first threshold that the system will remain stable when temperature testing is resumed with reference to the first temperature threshold. If the first temperature is greater than the dual temperature threshold, the first fan remains activated (block 138), until the first temperature falls below the dual threshold (block 140) and the process can continue (block 100). If the second temperature is higher, then the second fan is activated (block 144). The second temperature is compared to the dual temperature threshold (block 148) and the second fan remains activated (block 144) until the second temperature falls below the dual temperature threshold. The process then resumes with reference to the first temperature threshold (block 100).

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A system for cooling a heated image receiving member comprising:

a first temperature sensor for sensing a temperature in a first portion of an image receiving member;

a second temperature sensor for sensing a temperature in a second portion of an image receiving member;

a first fan for directing air from the first portion of the image receiving member to the second portion of the image receiving member;

a second fan for directing air from the second portion of the image receiving member to the first portion of the image receiving member;

a controller configured to activate the first fan in response to detection of the first temperature sensor sensing a temperature greater than a temperature threshold and the temperature sensed by the second temperature sensor being less than the temperature threshold, to activate the second fan in response to detection of the second temperature sensor sensing a temperature greater than the temperature threshold and the temperature sensed by the first temperature sensor being less than the temperature threshold, and to activate only one of the first and the second fans in response to detection of the first temperature sensor sensing a temperature greater than the temperature threshold and the second temperature sensor sensing a temperature greater than the temperature threshold.

2. The system of claim 1, the first portion of the image receiving member being heated by a first heater; and the second portion of the image receiving member being heated by a second heater.

3. The system of claim 2, the first and the second heaters being radiant heaters.

4. The system of claim 2, the first and the second heaters being convective heaters.

5. A system for cooling a heated image receiving member comprising:

a first temperature sensor for sensing a temperature in a first portion of an image receiving member;

a second temperature sensor for sensing a temperature in a second portion of the image receiving member;

a bi-directional fan for moving air across the image receiving member;

a controller configured to activate the bi-directional fan to move air from the first portion of the image receiving member to the second portion of the image receiving member in response to detection of the first temperature sensor sensing a temperature greater than a temperature threshold and the temperature sensed by the second temperature sensor being less than the temperature threshold, and configured to activate the bi-directional fan to move air from the second portion of the image receiving member to the first portion of the image receiving member in response to detection of the second temperature sensor sensing a temperature greater than the temperature threshold and the first temperature sensor sensing a temperature that is less than the temperature threshold.

6. The system of claim 5, the controller being further configured to activate the bi-directional fan to move air from the first portion of the image receiving member to the second portion of the image receiving member in response to detection of the first temperature sensor sensing a temperature greater than the temperature threshold and the temperature sensed by the second temperature sensor being greater than the temperature threshold.

7. The system of claim 6, the first portion of the image receiving member being heated by a first heater; and the second portion of the image receiving member being heated by a second heater.

8. The system of claim 7, the first and the second heaters being radiant heaters.

9. The system of claim 7, the first and the second heaters being convective heaters.

10. A method for cooling a heated image receiving member comprising:

detecting a temperature at a first portion of a heated image receiving member;

detecting a temperature at a second portion of the heated image receiving member;

directing air flow from the first portion of the heated image receiving member past the second portion in response to the detected temperature of the first portion being greater than a temperature threshold and the detected temperature of the second portion being less than the temperature threshold;

directing air flow from the second portion of the heated image receiving member past the first portion in response to the detected temperature of the first portion being less than the temperature threshold and the detected temperature of the second portion being greater than the temperature threshold; and directing air flow from the first portion of the heated image receiving member past the second portion in response to the detected temperature of the first portion being greater than the temperature threshold and the detected temperature of the second portion being greater than the temperature threshold.

11. The method of claim 10, the directing of the air flow from the first portion to the second portion further comprising:

controlling a fan to direct the air flow from the first portion of the heated image receiving member to the second portion of the image receiving member.

12. The method of claim 11, the directing of the air from the second portion to the first portion further comprising:

controlling the fan to direct air from the second portion of the heated image receiving member to the first portion of the image receiving member.

13. A printer comprising:

a rotatable image receiving member having a first end and a second end, the image receiving member rotating about its longitudinal axis;

a first heater mounted between the first and the second ends of the image receiving member to heat the image receiving member in the vicinity of the first end;

a second heater mounted between the first and the second ends of the image receiving member to heat the image receiving member in the vicinity of the second end;

a first temperature detector located proximate the first end of the image receiving member;

a second temperature detector located proximate the second end of the image receiving member;

a first bi-directional fan mounted at one end of the image receiving member; and a controller electrically coupled to the first and the second temperature detectors and the fan, the controller being configured to activate the fan to move air from the first end to the second end in response to a higher temperature being detected at the first end and the controller is configured to activate the fan to move air from the second end to the first end in response to the a higher temperature being detected at the second end.

14. A printer comprising:

a rotatable image receiving member having a first end and a second end, the image receiving member rotating about its longitudinal axis;

a first heater mounted between the first and the second ends of the image receiving member to heat the image receiving member in the vicinity of the first end;

a second heater mounted between the first and the second ends of the image receiving member to heat the image receiving member in the vicinity of the second end;

a first temperature detector located proximate the first end of the image receiving member;

a second temperature detector located proximate the second end of the image receiving member;

a first fan mounted at one end of the image receiving member;

a second fan mounted at the other end of the image receiving member from which the first fan is mounted;

a comparator for comparing a temperature detected by one of the first and the second temperature detectors to a temperature threshold; and a controller electrically coupled to the comparator, the first fan and the second fan, the controller being configured to activate the first fan to move air from the first end to the second end in response to a higher temperature being detected at the first end and the controller is configured to activate the second fan to move air from the second end to the first end in response to the a higher temperature being detected at the second end.

* * * * *